US005924542A

United States Patent [19]

Schwarzli

[11] Patent Number: 5,924,542

[45] **Date of Patent: *Jul. 20, 1999**

[54] COIN MECHANISM

[75] Inventor: Josef W Schwarzli, Stouffville, Canada

[73] Assignee: Machine-O-Matic Limited, Newmarket, Canada

[ * ] Notice: This patent is subject to a terminal disclaimer.

[21] Appl. No.: 08/893,308

[22] Filed: Jul. 15, 1997

Related U.S. Application Data

[62] Division of application No. 08/574,503, Dec. 19, 1995, Pat. No. 5,657,848, which is a continuation of application No. 08/237,529, May 3, 1994, abandoned.

[51] Int. Cl.[6] ..... G07F 5/04

[52] U.S. Cl. ..... 194/236; 194/237

[58] Field of Search ..... 194/236, 237, 194/255, 292, 351

[56] References Cited

U.S. PATENT DOCUMENTS

| | | | |
|---|---|---|---|
| 1,193,967 | 8/1916 | Antoine et al. | 194/242 |
| 2,069,200 | 2/1937 | Ackley | 194/351 X |
| 3,010,557 | 11/1961 | Weitzman | 194/236 |
| 3,620,342 | 11/1971 | Prescott | 194/236 |
| 5,657,848 | 8/1997 | Schwarzli | 194/236 |

FOREIGN PATENT DOCUMENTS

| | | | |
|---|---|---|---|
| 155396 | 2/1954 | Australia | 194/236 |
| 1018661 | 10/1957 | Germany | 194/236 |

*Primary Examiner*—F. J. Bartuska
*Attorney, Agent, or Firm*—Ralph E. Jocke; Mark B. Eisen

[57] ABSTRACT

A coin mechanism capable of accepting two coins simultaneously is provided with generally opposed coin slots with mechanisms for measuring each of the two coins immediately adjacent thereto. The measuring mechanisms includes detente cooperating with front and rear portions of a notched wheel, the detents being mounted so that only one detent cooperates with each portion of the notched wheel. The invention further provides a member for blocking access to the first coin slot as the second coin passes, to prevent removal of the coin therefrom.

24 Claims, 9 Drawing Sheets

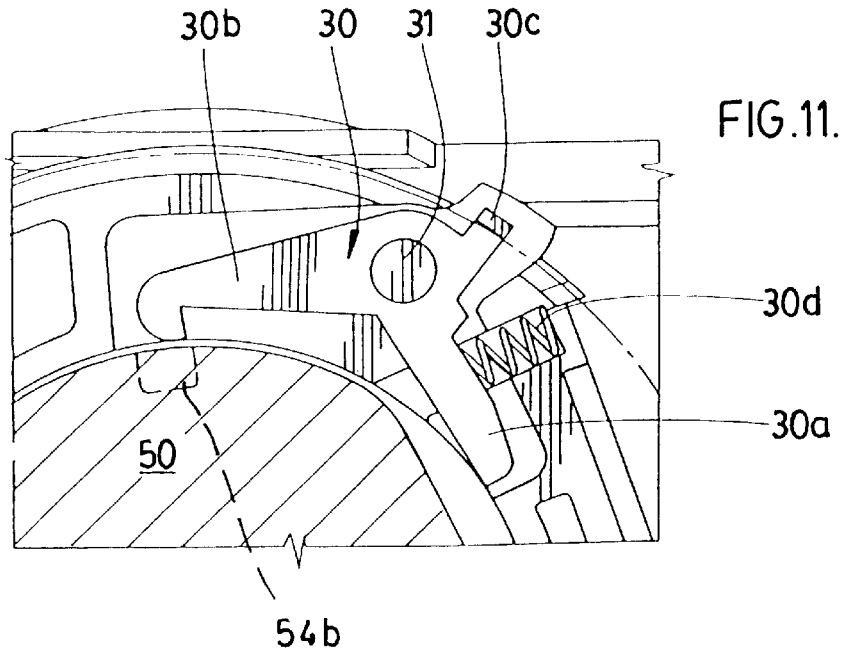
FIG.11.
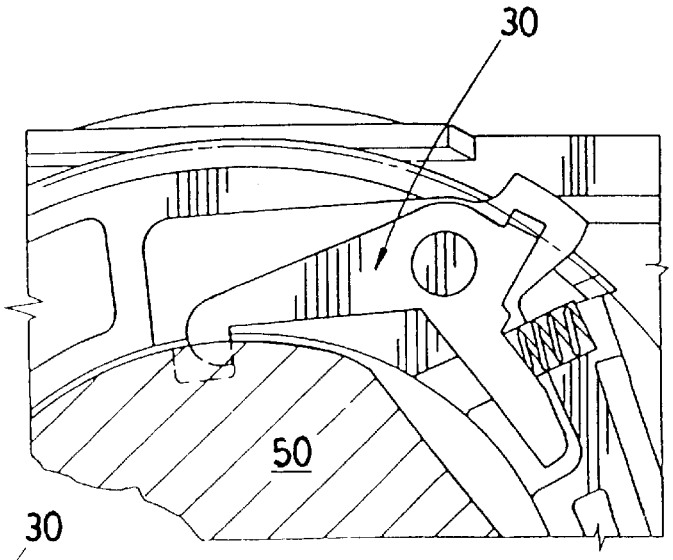
FIG.12.
FIG.13.
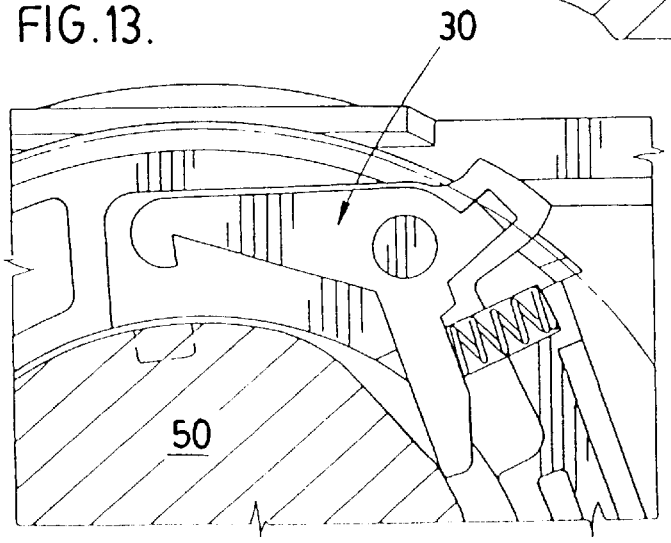

COIN MECHANISM

This application is a divisional application Ser. No. 08/574,503 filed on Dec. 19, 1995 now U.S. Pat. No. 5,657,848 which is a continuation of application Ser. No. 08/237,529 filed on May 3, 1994 now abandoned.

FIELD OF INVENTION

The present invention relates to coin mechanisms. In particular, the present invention relates to a coin mechanism for a bulk vendor capable of accepting two coins simultaneously.

BACKGROUND OF THE INVENTION

Bulk vendors are widely used for vending a wide variety of merchandise, from confectioneries to toys. Part of the appeal of bulk vendors is that they attract very little overhead in terms of both space and labour. Bulk vendors are typically located in high-traffic public areas, and require only periodic servicing to collect deposited coins, refill the product storage bin and, occasionally, to repair or replace parts. As such they are ideal for "self-service" sales of small articles.

For the same reasons, however, bulk vendors are frequently subject to abuse, and particularly to attempts to defeat the coin mechanism and obtain free merchandise. Many safety features have been developed over the years to prevent the theft of merchandise from bulk vendors, and while these measures have been largely successful they have only been employed in coin mechanisms which accept one coin for each turn of the handle.

Inflation has given rise to the need for bulk vendors which dispense merchandise only when two coins have been deposited into the vendor. Since conventional bulk vendors dispense merchandise with each rotation of the handle, in order to create a coin mechanism which can also be retrofitted to existing vendors it is necessary to design the coin mechanism to accept both coins before the handle can be rotated so that vendor will dispense merchandise.

This presents a difficult problem in a conventional vendor. The amount of "play" in the mechanism, i.e. the extent to which the handle can be turned without the correct coin being deposited, must be minimal in order to avoid exposing merchandise to the entrance of the dispensing chute without the proper coin being deposited (commonly known as "milking" the vendor). Thus, the coin must be measured for proper size as close as possible to the beginning of the turning cycle. In this way, if the coin is not the correct size the handle cannot be turned enough to expose merchandise to the dispensing chute, and the coin will be rejected (if too small) or must be removed from the coin slot in the carrier wheel.

In a coin mechanism which accepts two coins, this problem is exacerbated because both coins must be measured at the beginning of the turning cycle, in order to avoid both too much play in the mechanism and the dispensing of merchandise with only a single coin. However, because of size constraints, particularly if the coin mechanism is to fit into existing vendors, there is insufficient space to include two complete sets of coin measuring means.

Moreover, one of the two coins (the second in terms of the direction of rotation of the mechanism) must at some point during the turning cycle pass the coin slot for the first coin. If the second coin can be removed from the first coin slot as it passes, either without arresting the turning cycle or jamming the mechanism in the process, this also results in loss of revenue to the operator.

The present invention overcomes these disadvantages by providing a coin mechanism adapted to accept two coins simultaneously. Both coins are measured at beginning of the turning cycle, to minimize the amount of play in the mechanism and prevent milking of the vendor, by opposed measuring detents which cooperate with a single notched wheel. The notched wheel is provided with notches formed into the wheel in layers, i.e. one in each axial half-section of the wheel, and the detents are correspondingly mounted on the cover plate to cooperate only with the notches in one of the layers. In this fashion the notched wheel readily fits within the size constraints of the mechanism, and the detents are small enough and can be mounted far enough apart that they do not interfere with one another.

The invention further provides a stop member which is actuated by a cam to block access to the first coin slot as the second coin passes by it during the turning cycle, to prevent removal of the second coin. This also enables the two coin slots to be relatively far apart, which facilitates the positioning of the measuring detents, without delaying the measuring of the second coin to allow undue play in the mechanism.

These and other objects and advantages of the invention will be apparent from the description of the preferred embodiment of the invention which follows.

SUMMARY OF THE INVENTION

The present invention thus provides a coin mechanism for a vendor comprising a cover plate having first and second coin slots, a carrier wheel having first and second coin recesses in alignment with the coin slots when the carrier wheel is in a home position, for depositing a coin into each coin recess, rotating means for rotating the carrier wheel engaged to gear means for actuating a dispensing wheel, means for preventing rotation of the rotating means in a direction opposite to a direction of rotation of the mechanism, and means for preventing rotation of the rotating means substantially beyond the home position unless a coin of the correct size is deposited into each coin recess, including a first detent mounted on the cover plate adjacent to the first coin slot in the direction of rotation and a second detent mounted on the cover plate adjacent to the second coin slot in the direction of rotation, the detents cooperating with a notched wheel engaged to the rotating means to arrest rotation thereof, wherein the notched wheel is provided with front and rear portions each having at least one notch, the first detent being mounted so as to cooperate with the notch in the front portion of the notched wheel and the second detent being mounted so as to cooperate with the notch in the rear portion of the notched wheel.

The present invention further provides a coin mechanism for a vendor having a cover plate having first and second coin slots, a carrier wheel having first and second coin recesses in alignment with the coin slots when the carrier wheel is in a home position, for depositing a coin into each coin recess, rotating means for rotating the carrier wheel engaged to gear means for actuating a dispensing wheel, means for preventing rotation of the rotating means unless proper coins have been deposited into the coin slots, and means for blocking access to the second coin slot when the first coin recess comes into alignment therewith.

BRIEF DESCRIPTION OF THE DRAWINGS

In drawings which illustrate by way of example only a preferred embodiment of the invention.

FIGS. 11, 12 and 13 are partial cross sections showing the different operating positions of the detent of FIG. 10;

DETAILED DESCRIPTION OF THE INVENTION

Figure 1:
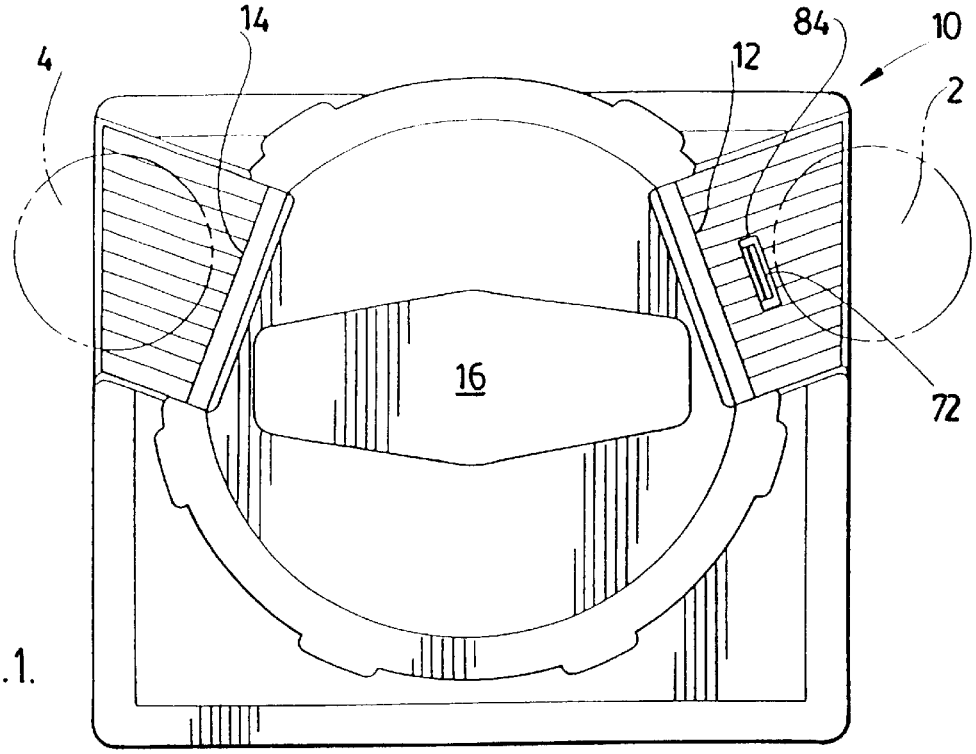
FIG. 1 is a front elevation of the coin mechanism of the present invention.
Figure 19:
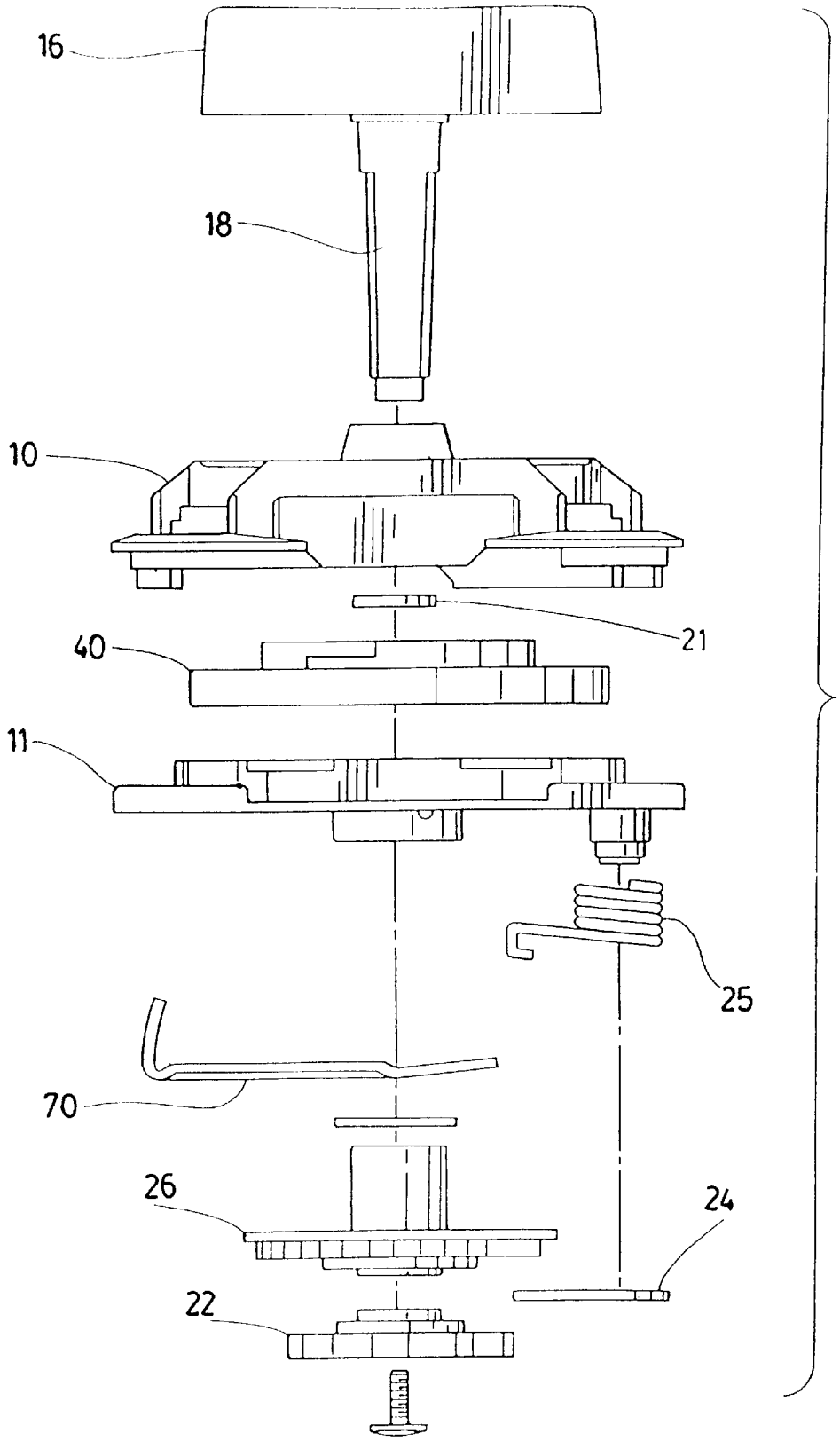
FIG. 19 is an exploded view of the coin mechanism.
Figure 20:
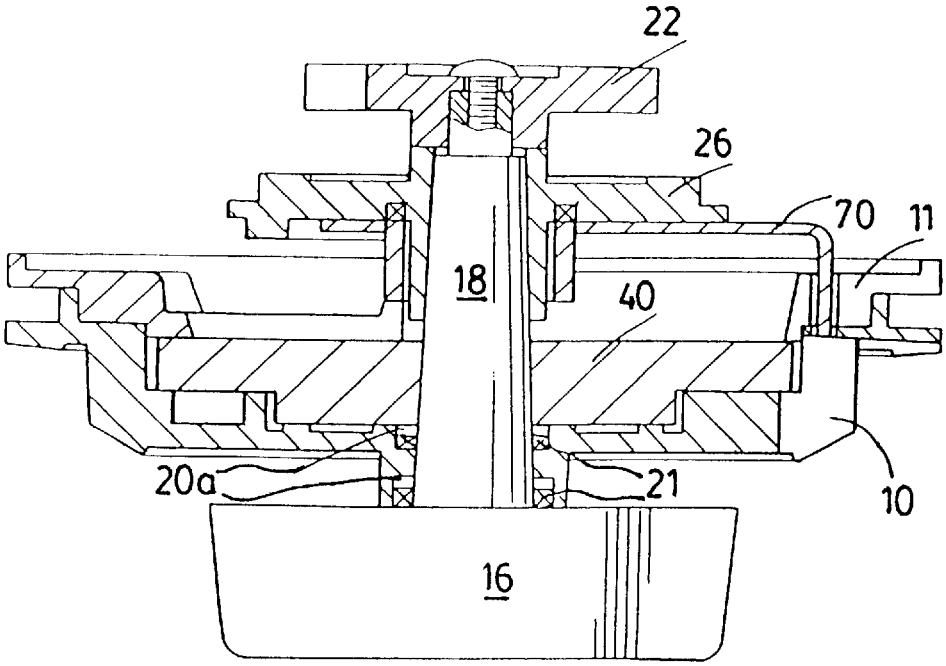
FIG. 20 is a cross section of the coin mechanism.

Referring to FIG. 1, a preferred embodiment of the invention includes a coin mechanism having a cover plate 10 provided with two coin slots 12,14, to receive two coins 2,4 simultaneously. Means for rotating the mechanism comprises a handle 16 with a shaft 18 extending through a bearing 20 in the cover plate 10, which bearing 20 may include front and rear recessed portions 20*a* each containing an oiled felt packing 21, as shown in FIGS. 19 and 20, for increased wear-resistance.

As seen in exploded view in FIG. 19, the shaft 18 extends through the various components of the invention described below to a gear 22. In a conventional bulk vendor, as is well known in the art, the gear 22 actuates a toothed dispensing wheel by bringing one of a plurality of product compartment openings in the dispensing wheel into alignment with a dispensing chute and thus dispensing merchandise with each complete rotation of the handle 16. An example of such a vendor can be found in U.S. Pat. No. 5,259.532, owned by the applicant, which is incorporated herein by reference.

Figure 2:
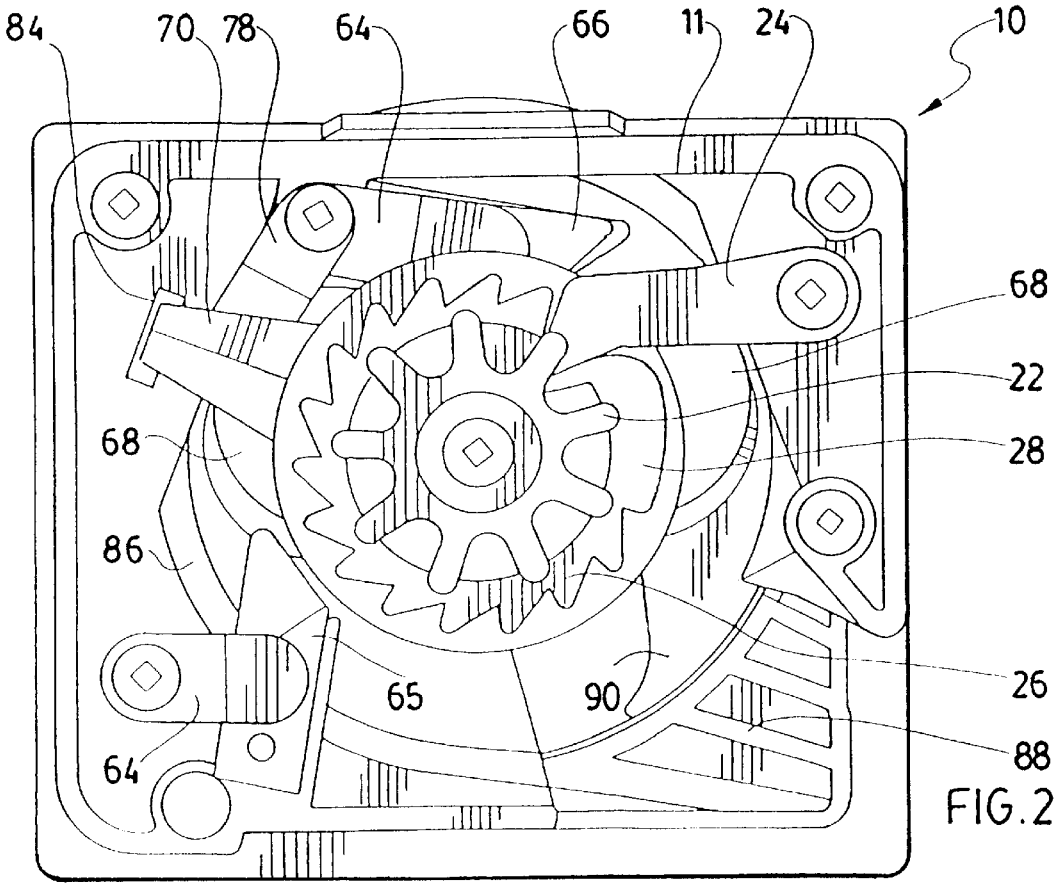
FIG. 2 is a rear elevation of the coin mechanism.
Figure 3:
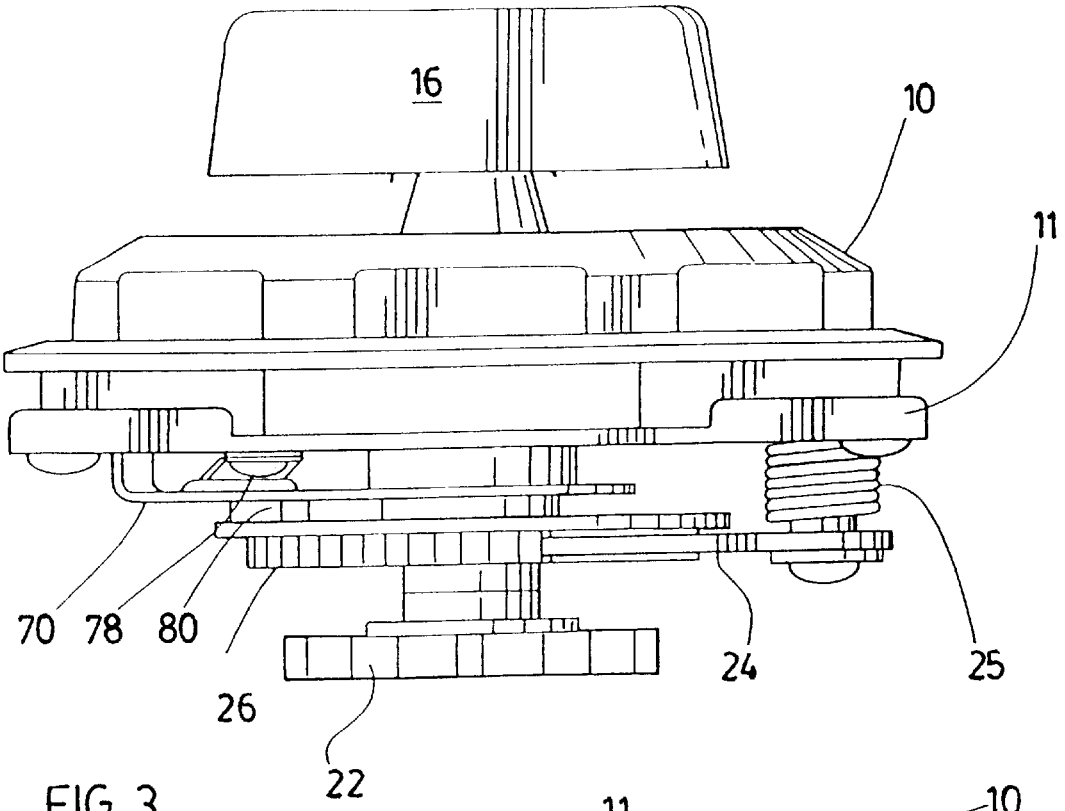
FIG. 3 is a top plan view.
Figure 4:
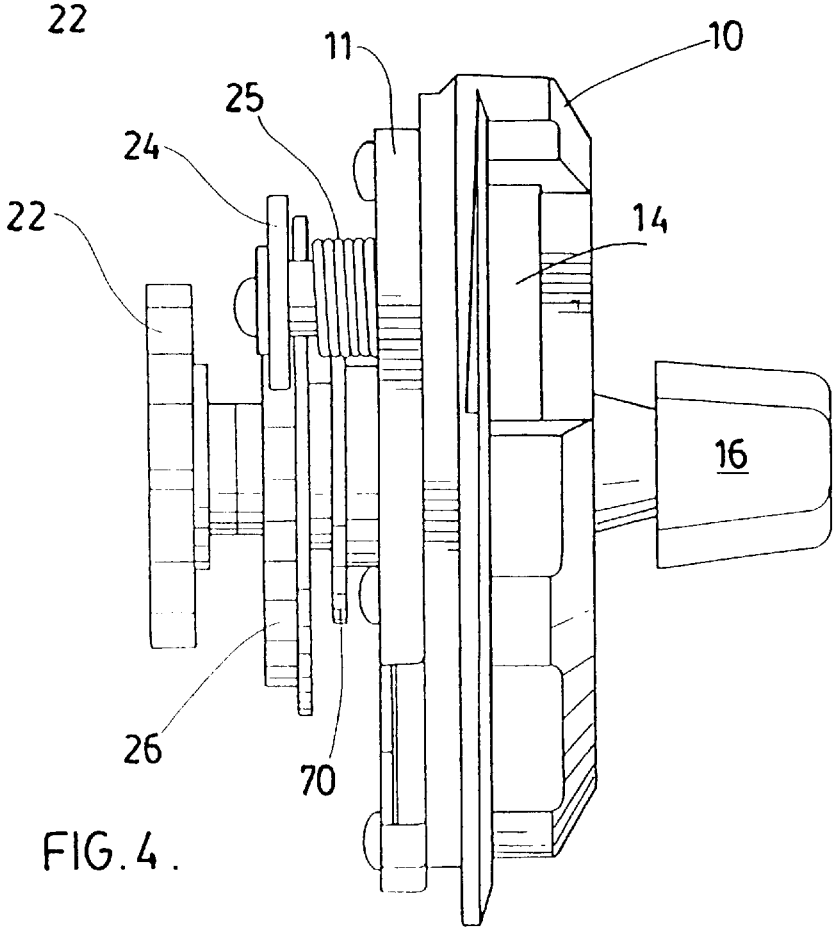
FIG. 4 is a side elevation.

Means for preventing rotation of the rotating means in a direction opposite to the direction of rotation of the mechanism comprises a pawl 24 biased by a torsion Spring 25 which cooperates with a ratchet-wheel 26. A small portion 28 of the ratchet-wheel 26 is not provided with teeth, as seen in FIG. 2, to permit slight reverse rotation of the mechanism at the beginning of the turning cycle. Thus, if a coin is not accepted by the mechanism (or no coin is deposited) at the measuring stage of the turning cycle, the mechanism can be rotated back to the home position (i.e. the beginning of the turning cycle) for further use of the vendor. It is this small amount of permitted reverse rotation which gives rise to "play" in the mechanism, and can result in "milking" of the vendor. It can therefore be seen that it is extremely important to measure the deposited coin(s) as close as possible to the home position.

Figure 5:
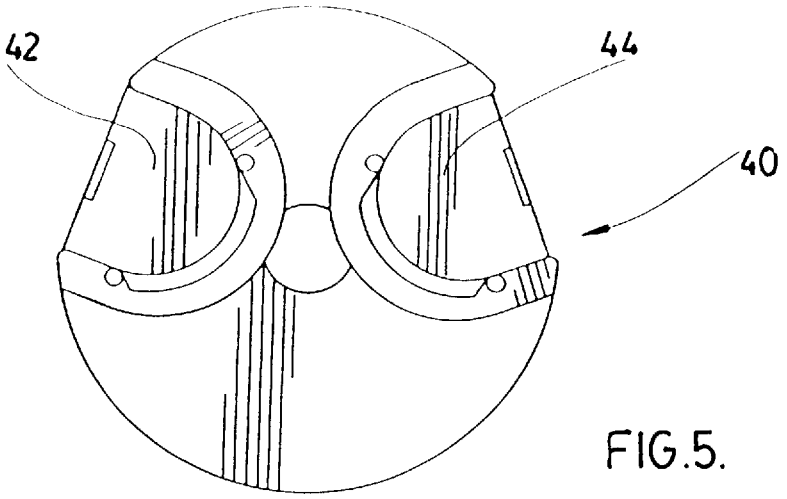
FIG. 5 is a rear elevation of the carrier wheel.
Figure 6:
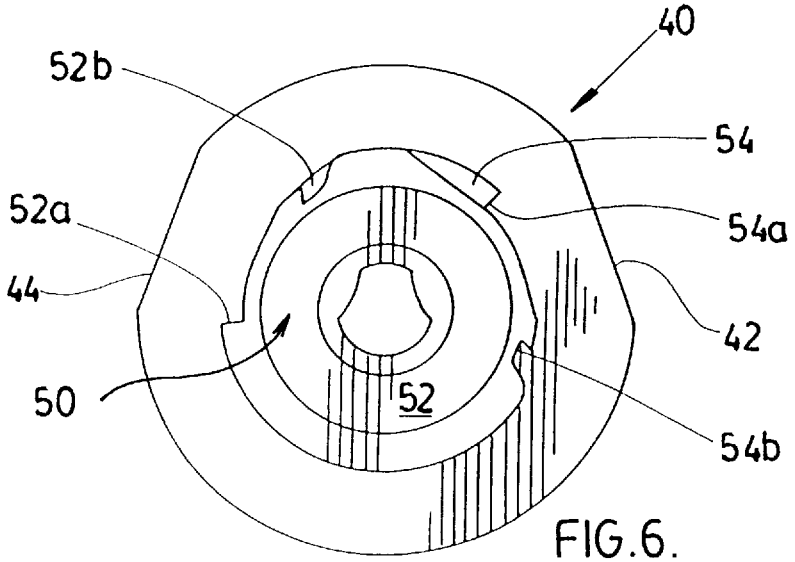
FIG. 6 is a front elevation of the carrier wheel.
Figure 7:
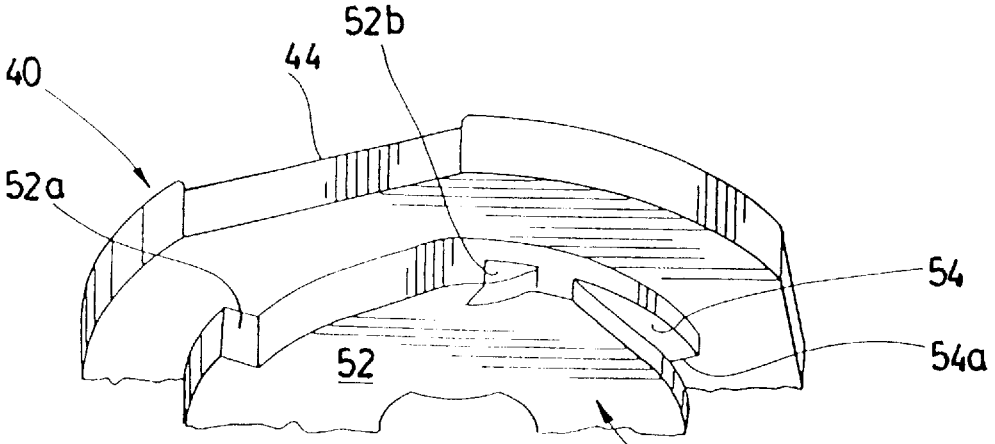
FIG. 7 is a partial perspective view of the carrier wheel.

The cover plate 10 in the coin mechanism of the present invention is cast with first and second coin slots 12, 14 oriented generally symmetrically about a vertical plane extending through the axis of rotation of the mechanism. A carrier wheel 40 for conveying coins 2,4, shown in FIG. 5, comprises first and second coin recesses 42,44 in alignment with the coin slots 12,14 respectively when the carrier wheel 40 is in the home position. The shaft 18 engages the carrier wheel 40 through its axis of rotation, so that rotating the handle 16 causes the carrier wheel 40 to rotate. The carrier wheel 40 is retained against the cover plate 10 by a retaining plate 11 bolted to the rear face of the cover plate 10.

Figure 8:
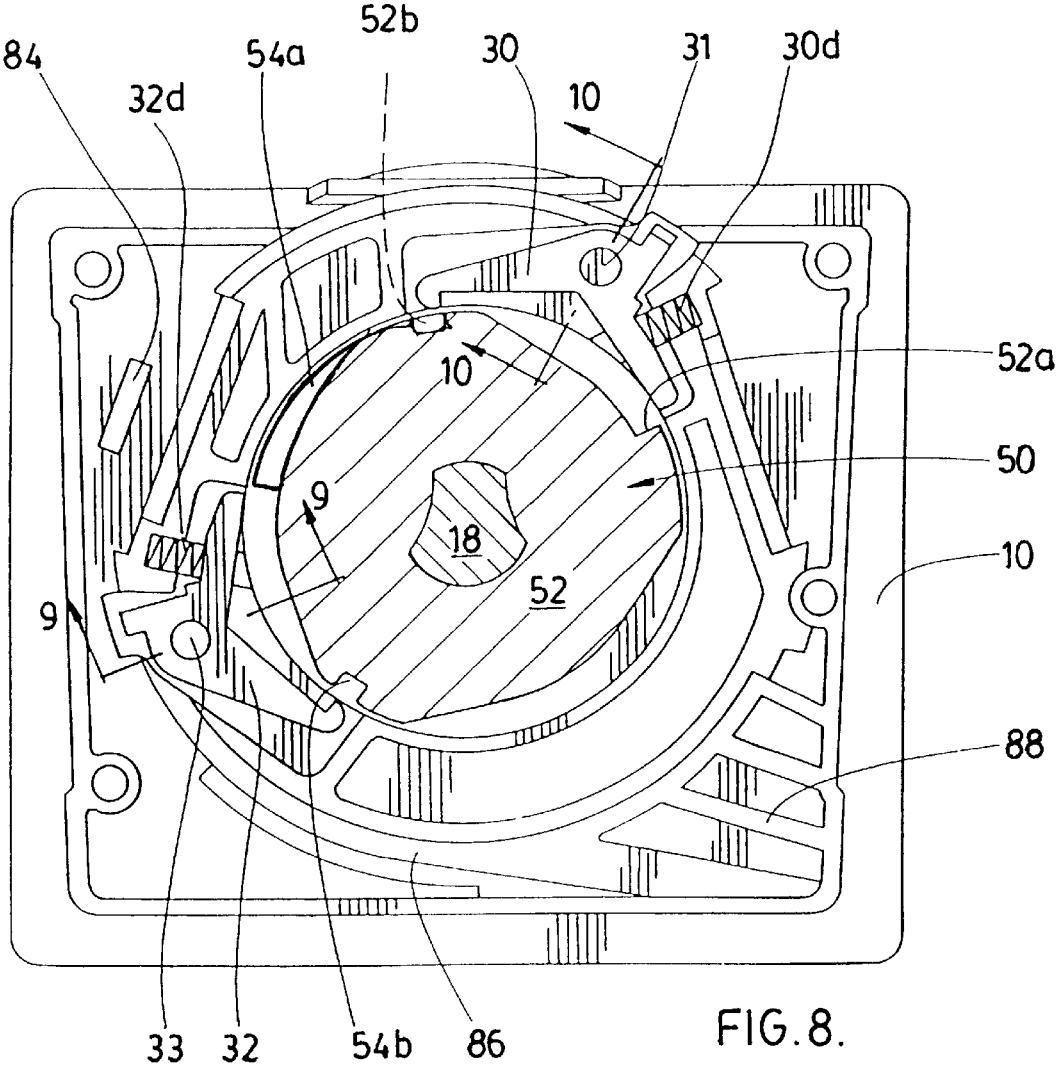
FIG. 8 is a rear elevation of the cover plate showing the positioning of the notched wheel and detents.

As best seen in FIG. 8, first and second detents 30,32 are pivotally mounted on pins 31,33 On the rear face of the cover plate immediately adjacent to each coin slot 12,14, respectively, in the direction of rotation of the mechanism (clockwise in the embodiment illustrated in FIGS. 1–21). According to this arrangement both Coins 2,4 are measured immediately downstream of the coin slots 12,14, as the coin recesses 42,44 in the carrier wheel 40 approach the detents 30,32, to allow for minimal play in the mechanism.

Figure 9:
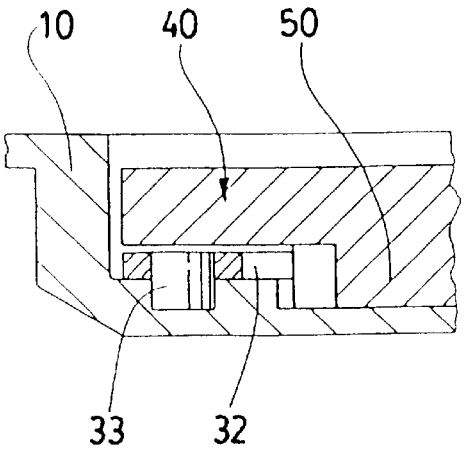
FIG. 9 is a partial cross section of the carrier wheel in the cover plate showing one of the detents.
Figure 10:
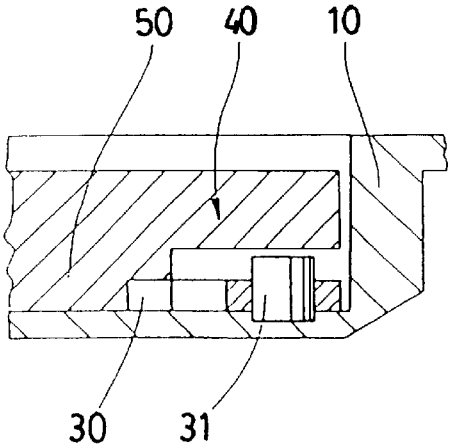
FIG. 10 is a partial cross section of the carrier wheel in the cover plate showing the other detent.

To accomplish this within the size constraints of the coin mechanism, the first detent 30 is recessed into the rear face of the cover plate slightly further tan the second detent 32, so that the planes in which the two detents 30,32 pivot are parallel but not coincident, as shown in FIGS. 9 and 10. In a preferred embodiment the carrier wheel 40 is provided on its front face with a notched wheel 50 consisting of front and rear portions 52,54, each in alignment with one of the detents 30,32. The notched wheel 50 may be formed integrally with the carrier wheel 40 or attached thereto, or may be a separate piece engaged to the shaft 18 so as to rotate therewith.

When the carrier wheel 40 is in position in the rear of the cover plate 10, the front portion 52 of the notched wheel 50 rides against bearing ridges 60,62 on the rear face of the cover plate 10 (see FIG. 20). The rear portion 54 of the notched wheel is thus in the pivoting plane of the second detent 32, as in FIG. 9, and the front portion 52 of the notched wheel 50 is in the pivoting plane of the first detent 30, as in FIG. 10. As such, each detent 30,32 cooperates only with the respective portion 52,54 of the notched wheel 50 with which it is in alignment, so that each detent 30,32 measures independently of the other.

Measurement of the coins 2,4 is effected by the detent 30 or 32 as follows, with reference to FIGS. 11 to 13 which illustrate the detent 30 by way of example. The detent 30 includes a leading arm 30*a*, a trailing arm 30*b* and an orthogonal boss 30*c*. The detent 30 is biased by a compression spring 30*d* so that the leading arm 30*a* bears against the notched wheel 50 (more specifically in the case of the detent 30, the front portion 52 of the notched wheel 50), as in FIG. 13. If an attempt is made to rotate the mechanism with no coin (or an undersized coin) in the coin recess 44, the leading arm 30*a* will come in contact with the notch 52*a* and the rotation will be arrested. An oversized coin will contact the boss 30*c* and force the trailing arm 30*b* against the notched wheel 50, so that the hooked nose of the trailing arm 30*b* lodges in the notch 52*b*, as in FIG. 12. A coin 2 of the correct size will contact the boss 30*c* and force the detent 30 to pivot just enough to allow the notches 52*a*,52*b* to pass the detent 30 freely, as shown in FIG. 11. The operation of the detent 32 is exactly the same, relative to the rear portion 54 of the notched wheel 50.

It will be appreciated that the detent 30 can only cooperate with the notches 52*a*,52*b* in the front portion 52 of the notched wheel 50, and the detent 32 can only cooperate with the notches 54*a*,54*b* in the rear portion 54 of the notched wheel 50, because of the axial positioning of the respective detents 30,32 within the rear of the cover plate 10. It will also be appreciated that the front and rear portions 52,54 of the notched wheel 50 can be formed as separate pieces, one overlaying the other on the shaft 18, but because both are engaged to the shaft 18 and rotate therewith they would effectively constitute a single notched wheel 50 operating as described above.

The coins 2,4 are also tested by washer dogs 65,66 biased by leaf springs 64 toward the carrier wheel 40. If the centre of the deposited "coin" is not solid, for example if a washer is deposited into one of the coin slots 12,14, the nose of the washer dog 65 or 66 slips into the open center of the washer and arrests rotation of the mechanism. The washer dogs 65,66 also measure the thickness of the coin 2 or 4. If the coin 2 or 4 is too thin, the nose of the washer dog 65 or 66 will catch on the trailing edge of the coin recess 42 or 44 respectively and arrest rotation of the mechanism.

It can thus be seen that the coins 2,4 deposited into the coin slots 12,14 are tested and measured for correct size immediately adjacent to the coin slots 12,14, before a product compartment in the dispensing wheel becomes exposed to the dispensing chute. If one or both coins are rejected, the mechanism may be rotated in reverse back to the home position to remove the rejected coins (or undersized coins will fall out of the mechanism through an undersized coin hole 68 in the retaining plate 11, as is conventional). Assuming that the coins 2,4 are accepted, the turning cycle can continue.

As the handle 16 is turned past the measuring stage of the turning cycle, the coin 4 deposited through the slot 14 into the second coin recess 44 (i.e. the second coin recess relative to the direction of rotation of the mechanism) will pass the first coin slot 12. If the coin 4 were removed from the second coin recess 44 at this stage of the turning cycle through the first coin slot 12, this would arrest further rotation of the mechanism because the detent 32 and washer dog 65 will prevent further rotation as in the "no coin" condition described above. The pawl 24 and ratchet-wheel 26 would prevent reverse rotation of the mechanism at this stage of the turning cycle, and the mechanism would therefore jam.

Figure 16:
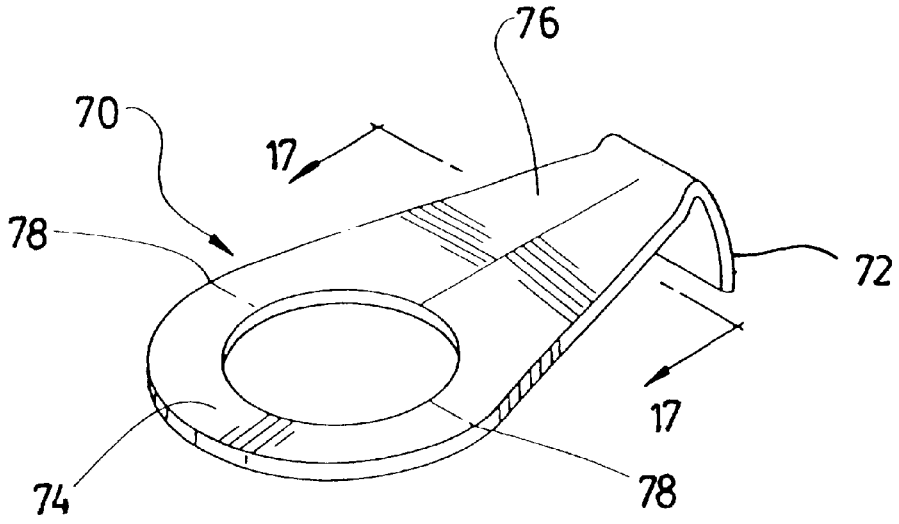
FIG. 16 is a perspective view of the rocker bar.
Figure 17:
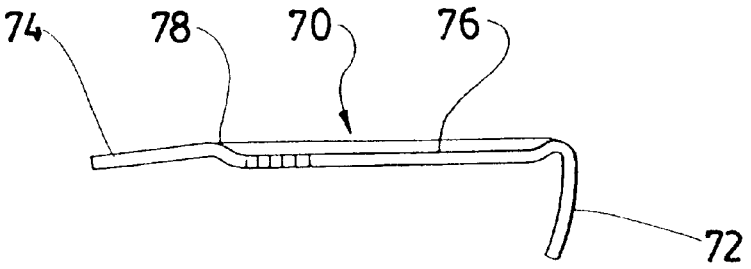
FIG. 17 is a side elevation of the rocker bar.
Figure 18:
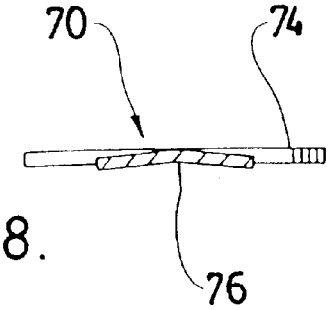
FIG. 18 is a cross section of the rocker bar.

To avoid removal of the coin 4 from the first coin slot 12 the invention provides means for blocking access to the first coin slot 12 comprising a stop member, in the preferred embodiment a blade 72 projecting from a rocker bar 70, illustrated in FIGS. 16 to 18. The rocker bar 70 includes a ring 74 for loose-fitting engagement around the shaft 18, and a stem 76 from which the blade 72 projects generally orthogonally, as seen in FIG. 17. The stem 76 is bent slightly longitudinally as shown in FIG. 18, both for strength and to reduce the surface area that contacts the front face of the ratchet-wheel 26, as described below. The ring 74 is bent slightly in a direction perpendicular to the stem 76, as at 78, to facilitate a small degree of rocking motion.

Figure 14:
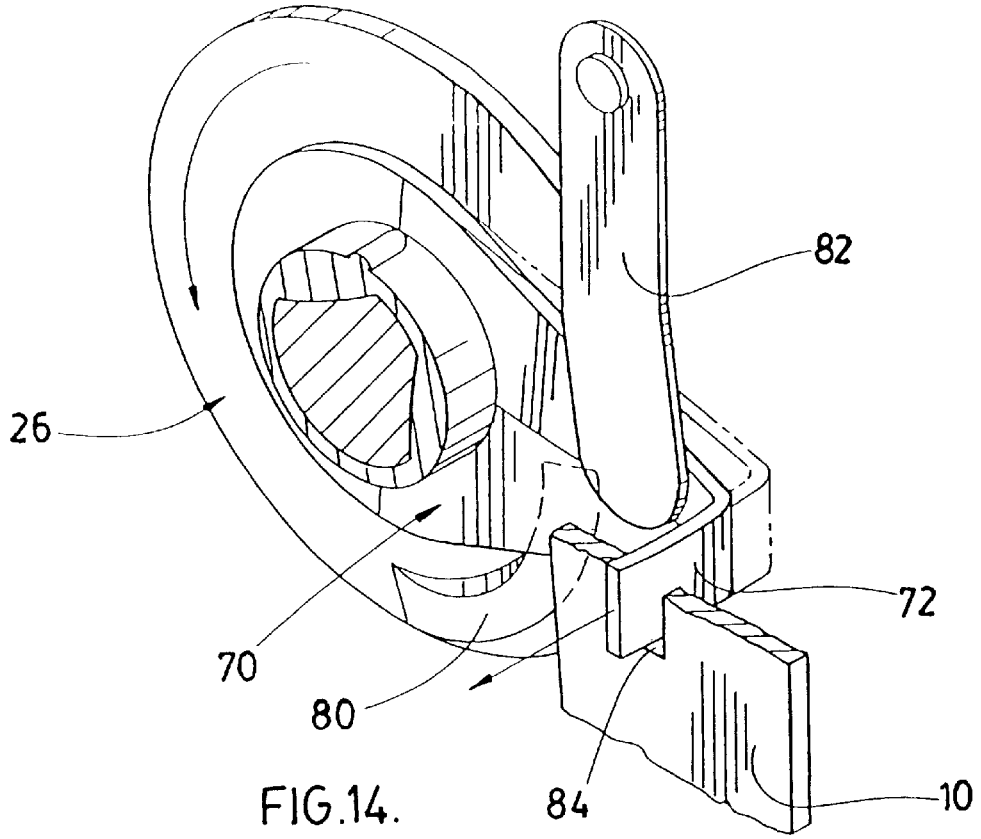
FIG. 14 is a perspective view of the stop member.
Figure 15:
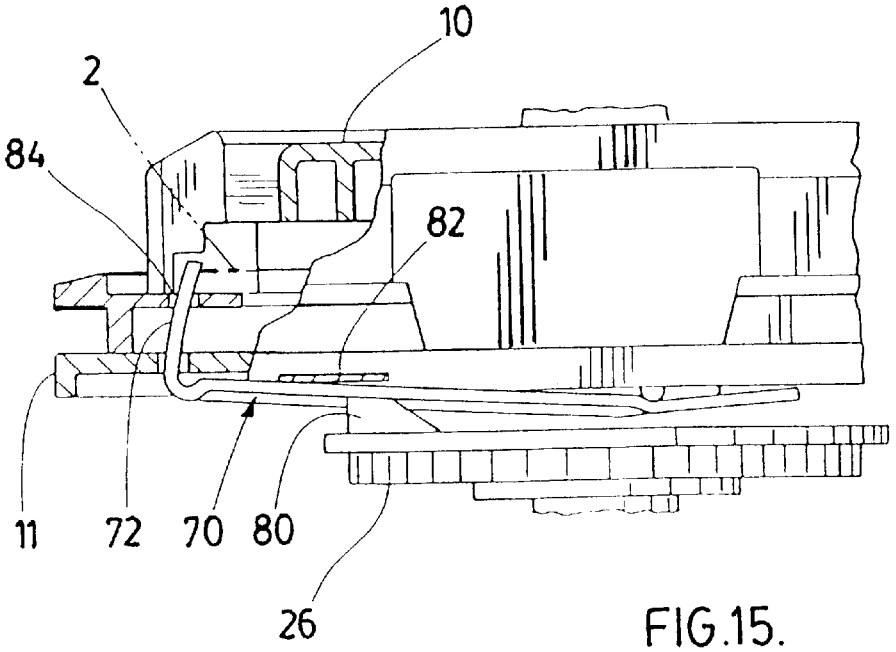
FIG. 15 is a side elevation of the stop member mounted in the coin mechanism.

The rocker bar 70 is mounted over the shaft 18 forwardly of the ratchet-wheel 26, as best seen in FIG. 15. The front face of the ratchet-wheel 26 is provided with a cam 80, being an elongated axial projection having gently sloping ends, as shown in FIG. 14. A leaf spring 82 anchored to the retaining plate 11 biases the rocker bar 70 against the front face of the ratchet-wheel 26, and the blade 72 is thus in its rest position immediately behind a slot 84 adjacent to the first coin slot 12. This can be seen in FIG. 1.

As the handle 16 is turned the ratchet-wheel 26 is rotated. The cam 80 is located behind the second coin recess 44 in the carrier wheel 40, so that as the second coin 4 approaches the first coin slot 12, the cam 80 forces the stem 76 of the rocker bar 70 forwardly. This causes the blade 72 to project forwardly out of the slot 84, as best seen in FIG. 15, and the blade 72 thus blocks access to the coin slot 12 prevent removal of the coin 4 therefrom and jamming the mechanism. After the second coin recess 44 has cycled past the first coin slot 12 the cam 80 runs off of the rocker bar 70 and the blade 72 recedes to its rest position, retracted from the slot 84. If a user attempts to shear off or bend the blade 72 to remove the second coin 4 from the first coin slot 12, rotation of the mechanism will thus be arrested by the operation of the detent 32 and/or washer dog 65.

As each coin 2 or 4 approaches the bottom of the cover plate 10 the outer edge of the coin 2 comes into contact with a ramped surface 86 cast into the rear face of the cover plate 10. The ramp 86 extends progressively rearwardly in the direction of rotation of the mechanism, to gradually pry the bottom edge of the coin 2 or 4 out of the coin recess 42 or 44 until it reaches the ejection ramp 88. In cases where a user attempts to glue or tape the coin 2 or 4 into the coin recess 42 or 44, which might enable repeated revolutions of the coin mechanism without depositing further coins, the slow rearward progression of the ramp 86 will overcome the adhesive and loosen the coin 2 or 4 from the coin recess 42 or 44.

Figure 21:
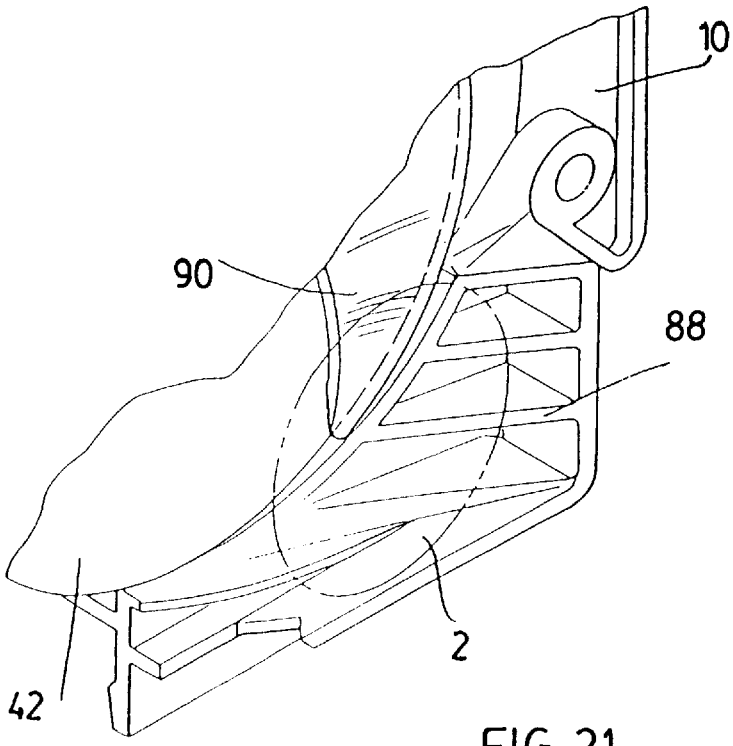
FIG. 21 is a partial perspective view showing the ejection ramp.

As illustrated in FIG. 21, the retaining plate 11 is provided with a finger 90 which further assists in the removal of the coin 2 from the mechanism, by sharply increasing the ramp angle immediately before the entrance to the ejection ramp 88 and prying the top portion of the coin 2 or 4 out of the coin recess 42 or 44. This avoids the situation where a buildup of coins in the cash bin prevents the coin 2 or 4 from falling downward out of the coin mechanism. The finger 90 acts as a wedge which forces the coin 2 or 4 laterally out of the coin recess 42 or 44, regardless of any buildup of coins in the cash bin.

The invention having been thus described with reference to a preferred embodiment, it will be apparent to those skilled in the art that certain modifications and adaptations may be made without departing from the scope of invention, as set out in the appended claims.

I claim:

1. A mechanism comprising:

a cover plate having first and second coin slots, a carrier wheel having first and second coin recesses in alignment with the coin slots when the carrier wheel is in a home position, wherein each of the first and second coin recesses are sized to accept a coin into each coin recess, rotating means for rotating the carrier wheel engaged to gear means for actuating a dispensing wheel, means for preventing rotation of the rotating means in a direction opposite to a direction of rotation of the mechanism, and means for preventing rotation of the rotating means substantially beyond the home position unless a coin of the correct size is deposited into each coin recess, including a first detent mounted in supporting connection with the cover plate adjacent to the first coin slot in the direction of rotation and a second detent mounted in supporting connection with the cover plate adjacent to the second coin slot in the direction of rotation, the detents cooperating with a notched wheel operatively connected to the rotating means to arrest rotation thereof, wherein the notched wheel is operatively connected with front and rear portions each having at least one notch, the first detent being positioned so as to cooperate with the notch in the front portion and the second detent being positioned so as to cooperate with the notch in the rear portion.

2. The coin mechanism of claim 1 in which the front and rear portions of the notched wheel are formed as separate pieces.

3. The coin mechanism of claim 1 in which the front and rear portions of the notched wheel are formed as a single piece.

4. The coin mechanism of claim 3 in which the notched wheel is attached to or integral with a front face of the carrier wheel.

5. The coin mechanism of claim 1 in which the detents are each provided with a leading arm and a trailing arm, and the front and rear portions of the notched wheel each include two notches.

6. The coin mechanism of claim 1 in which the coin slots are formed in the cover plate generally symmetrically about a vertical plane extending through an axis of rotation of the mechanism.

7. A coin mechanism comprising:

a cover plate having first and second coin slots, a carrier wheel having first and second coin recesses in alignment with the coin slots when the carrier wheel is in a home position, wherein in the home position the carrier wheel is adapted to receive a coin into each coin recess, a rotatable member operatively connected to the carrier wheel, wherein the rotatable member is movable relative to the cover plate and is operative to rotate the carrier wheel wherein rotation of the carrier wheel is adapted to actuate a dispensing mechanism, a rotation preventing device operatively connected between the cover plate and the rotatable member, wherein the rotation preventing device is operative to generally prevent rotation of the rotatable member unless proper coins have been deposited into the coin slots, a movable stop member in operative connection with the rotatable member and positioned adjacent the second coin slot, wherein the stop member moves to generally block access to the second coin slot when the first coin recess is in generally aligned relation with the second coin slot.

8. The coin mechanism of claim 7 wherein the stop member extends in an opening adjacent to the second coin slot and extends from the opening when the first coin recess is generally in alignment with the second coin slot.

9. The coin mechanism of claim 7 wherein the movable stop member comprises a bar having a blade mounted adjacent to an opening in the cover plate adjacent to the second coin slot, the bar being actuated by a cam in operative connection with the rotatable member wherein when the first coin recess approaches the second coin slot the cam is operative to move the blade in the opening in the cover plate to generally block access to the second coin slot whereby removal of the coin in the first coin recess through the second coin slot is prevented.

10. The coin mechanism of claim 9 including a reverse rotation device operatively connected between the cover plate and rotatable member wherein the reverse rotation device is operative to prevent rotation of the rotatable member in an opposite direction opposite to an operating direction of rotation of the coin mechanism.

11. The coin mechanism of claim 10 wherein the reverse rotation device comprises a ratchet wheel and a pawl, wherein the cam is positioned adjacent a front face of the ratchet wheel and wherein the cam comprises an elongated projection having gently sloping ends.

12. The coin mechanism of claim 8 wherein the stop member includes a stem from which a blade projects, the stem being bent along a longitudinal direction.

13. The coin mechanism of claim 9 wherein the bar includes a stem from which the blade projects, the stem being bent along a longitudinal direction.

14. The coin mechanism of claim 8 wherein the rotatable member extends along an axis of rotation and the stop member includes a ring portion which extends in generally surrounding relation of the rotating member.

15. The coin mechanism of claim 9 wherein the rotatable member extends along an axis of rotation and the bar includes a ring portion in generally surrounding relation of the rotatable member.

16. The coin mechanism of claim 7 wherein the carrier wheel is retained against the cover plate by a retaining plate secured to the cover plate, the retaining plate being provided with a rearwardly extending finger adjacent to an ejection ramp formed in the cover plate, for prying a coin laterally out of a coin recess.

17. A coin mechanism, comprising:

a cover plate including separate, angularly disposed, generally co-planar first and second coin slots, a carrier wheel having first and second coin recesses in alignment with the coin slots when the carrier wheel is in a home position, wherein in the home position a coin may be accepted into each coin recess, a rotatable member in movable supporting connection with the cover plate, wherein the rotatable member is operatively connected to the carrier wheel and wherein rotation of the rotatable member in an operating direction is operative to rotate the carrier wheel generally about an axis, wherein rotation of the carrier wheel is adapted to move a dispensing mechanism, a ratchet device operatively extending between the cover plate and the rotatable member, wherein the ratchet device is operative to prevent rotation of the rotatable member in an opposed direction opposite to the operating direction, and a rotation preventing device operatively extending between the cover plate and the rotatable member, wherein the rotation preventing device is operative to prevent rotation of the rotatable member in the operative direction substantially beyond the home position unless a coin of the correct size is deposited into each coin recess, the rotation preventing device including a first detent adjacent to the first coin slot and in the operating direction therefrom and a second detent adjacent to the second coin slot and in the operative direction therefrom, wherein the second detent is disposed from said first detent in a direction generally parallel to the axis of rotation of the carrier wheel.

18. The coin mechanism of claim 17 and further comprising a cam in operative connection with the rotatable a rocker bar in operative connection with the cam, and wherein the cover plate includes a slot extending adjacent to the second coin slot, and wherein the rocker bar is in operative connection with a blocking portion, wherein blocking portion is operative to extend in the slot generally blocking access to the second coin slot when the rotatable shaft is moved from the home position.

19. The coin mechanism of claim 18 in which the cam is attached to or forms part of a front face of a ratchet-wheel cooperating with a pawl to prevent rotation of the rotatable shaft in the opposite direction.

20. The coin mechanism of claim 19 in which the cam comprises an elongated projection having gently sloping ends.

21. The coin mechanism of claim 17 wherein the carrier wheel is retained against the cover plate by a retaining plate secured to the cover plate, the retaining plate being provided with a rearwardly extending finger adjacent to an ejection ramp formed in the cover plate, for prying a coin laterally out of a coin recess.

22. The coin mechanism of claim 17 wherein the rotation preventing device includes first and second notch portions operatively engageable respectively with the first and second detents, wherein the first and second notch portions are in operative connection with the rotatable member and wherein rotation thereof in the operating direction is prevented unless a coin of a correct size is deposited in each coin recess.

23. The coin mechanism of claim 22 and further comprising a notch wheel in operative connection with the member, wherein the notch wheel includes the first and second notch portions.

24. The coin mechanism of claim 23 wherein the notch wheel includes front and rear portions in supporting connection respectively with the first and second notch portions, the first detent being positioned so as to cooperate with the first notch portion in supporting connection with the front portion of the notch wheel, and the second detent being positioned so as to cooperate with the second notch portion in supporting connection with the rear portion of the notch wheel.

* * * * *